US009169543B2

(12) United States Patent
Kawabata et al.

(10) Patent No.: US 9,169,543 B2
(45) Date of Patent: Oct. 27, 2015

(54) PRECIPITATION-HARDENED, MARTENSITIC, CAST STAINLESS STEEL HAVING EXCELLENT MACHINABILITY AND ITS PRODUCTION METHOD

(75) Inventors: Masahide Kawabata, Moka (JP); Seiichi Endo, Moka (JP); Masanori Hara, Moka (JP); Koki Otsuka, Moka (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 12/532,351

(22) PCT Filed: Mar. 21, 2008

(86) PCT No.: PCT/JP2008/055331

§ 371 (c)(1),
(2), (4) Date: Sep. 21, 2009

(87) PCT Pub. No.: WO2008/123159

PCT Pub. Date: Oct. 16, 2008

(65) Prior Publication Data

US 2010/0089504 A1 Apr. 15, 2010

(30) Foreign Application Priority Data

Mar. 22, 2007 (JP) ..... 2007-074975

(51) Int. Cl.

| | |
|---|---|
| ***C22C 38/42*** | (2006.01) |
| ***C22C 38/48*** | (2006.01) |
| ***C21D 6/00*** | (2006.01) |
| ***C21D 6/02*** | (2006.01) |
| *C21D 1/25* | (2006.01) |

(52) U.S. Cl.

CPC ..... *C22C 38/42* (2013.01); *C21D 6/004* (2013.01); *C21D 6/005* (2013.01); *C21D 6/02* (2013.01); *C22C 38/48* (2013.01); *C21D 1/25* (2013.01); *C21D 2211/004* (2013.01); *C21D 2211/008* (2013.01)

(58) Field of Classification Search

CPC .. C22C 38/48; C22C 38/42; C22C 2211/004; C21D 6/004; C21D 6/005; C21D 6/02; C21D 1/25; C21D 2211/008

USPC ..... 148/326, 605

See application file for complete search history.

(56) References Cited

U.S. PATENT DOCUMENTS 3,574,601 A * 4/1971 Myers et al. ..... 420/38
4,769,213 A * 9/1988 Haswell et al. ..... 420/61

FOREIGN PATENT DOCUMENTS

JP 2002285287 A * 10/2002 ..... C22C 38/00
JP 2003-027133 A 1/2003

(Continued)

OTHER PUBLICATIONS

Machine translation of JP 2003027133.*

(Continued)

*Primary Examiner* — Rebecca Lee
(74) *Attorney, Agent, or Firm* — Sughrue Mion, PLLC

(57) ABSTRACT

Precipitation-hardened, martensitic, cast stainless steel having a composition comprising, by mass, 0.08-0.18% of C, 1.5% or less of Si, 2.0% or less of Mn, 0.005-0.4% of S, 13.5-16.5% of Cr, 3.0-5.5% of Ni, 0.5-2.8% of Cu, 1.0-2.0% of Nb, and 0.12% or less of N, the amounts of C, N and Nb meeting the condition of $-0.2 \leq 9$ (C %+0.86N %)−Nb %≤1.0, the rest being Fe and inevitable impurities, and having a structure in which Cu precipitates having an average particle size of 0.1-0.4 μm are dispersed in a tempered-martensite-based matrix.

4 Claims, 2 Drawing Sheets

(56) References Cited

FOREIGN PATENT DOCUMENTS

| | | | | | |
|---|---|---|---|---|---|
| JP | 2003013185 | A | * | 1/2003 | ..... C22C 38/00 |
| JP | 2004-332020 | A | | 11/2004 | |
| JP | 2005-298840 | A | | 10/2005 | |

OTHER PUBLICATIONS

Machine translation of JP 2005298840.*
Machine Translation of JP 2002285287, 2002.*
Machine translation of JP 2003013185, 2003.*

* cited by examiner

PRECIPITATION-HARDENED, MARTENSITIC, CAST STAINLESS STEEL HAVING EXCELLENT MACHINABILITY AND ITS PRODUCTION METHOD

CROSS REFERENCE TO RELATED APPLICATIONS

This application is a National Stage of International Application No. PCT/JP2008/055331 filed Mar. 21, 2008, claiming priority based on Japanese Patent Application No. 2007-074975, filed Mar. 22, 2007, the contents of all of which are incorporated herein by reference in their entirety.

FIELD OF THE INVENTION

The present invention relates to precipitation-hardened, martensitic, cast stainless steel having good castability and high strength as well as excellent machinability in a tempered state, which is suitable for machine parts and structure parts, and its production method.

BACKGROUND OF THE INVENTION

As cast stainless steel suitable for machine parts and structure parts requiring high strength, SCS, SCH, etc. have been known conventionally. SCS is precipitation-hardened, martensitic, cast stainless steel containing Cu, Al, etc., which is provided with desired strength, hardness, toughness, corrosion resistance, wear resistance, etc. by turning a main phase in a matrix to martensite by a quenching or solution treatment (called "quenching treatment" summarily), and then forming precipitates of Cu, Al, etc. in the martensite matrix by a tempering or aging treatment (called "tempering treatment" summarily). Among them, SCS24 of JIS G5121 is a typical precipitation-hardened, martensitic, cast stainless steel containing Cu as a precipitation-hardening element, which is widely used for machine parts and structure parts for automobiles, vessels, construction machines, chemical plants, industrial machines, etc. However, the precipitation-hardened, martensitic, cast stainless steel tends to have poor cuttability (machinability), when provided with high hardness and strength.

As precipitation-hardened, martensitic, stainless steel having strength, hardness, toughness, corrosion resistance and wear resistance like SCS24, SUS630 is also known, but it has poor plastic workability (cold workability and warm workability) such as forging, rolling, extrusion, etc. and machinability in a tempered (aged) state, because of a structure having precipitates dispersed in a martensite matrix, and high hardness and strength. Accordingly, large plastic working or machining is conducted on the hardened SUS-type steel before tempering.

Proposed to improve the workability of the precipitation-hardened, SUS-type steel are, for instance, (a) to reduce C to 0.03-0.05% and N to 0.025-0.035% to lower hardness after a quenching treatment, thereby improving workability, (b) to add a small amount of S or Se to precipitate sulfides or selenides, thereby improving machinability, and (c) to optimize a composition range or quenching conditions, or conduct an annealing treatment during rolling to lower hardness after a quenching treatment, thereby improving workability.

However, the above methods for SUS-type steel are not suitable for improving the machinability of SCS-type cast steel. Decrease in C and N as interstitial solid solution elements in a martensite matrix extremely reduces castability, though it lowers the hardness of martensite. Particularly in cast steel with a complicated or thin shape, too little C fails to provide good melt fluidity, resulting in melt flow defects such as cold shuts, misrun, etc. Also, only the addition of S or Se fails to improve machinability sufficiently. Although any of the above methods improves workability after quenching, it does not consider workability after tempering.

Precipitation-hardened, martensitic stainless steel cast in a shape close to a final product (near-net shape) is usually roughly worked after quenching, tempered to have high hardness, strength, wear resistance, etc., and then finish-worked to remove scale and strain generated by the tempering treatment and to have desired surface roughness and dimensional accuracy. Thus important for the precipitation-hardened, martensitic, cast stainless steel are not only machinability after quenching but also machinability after tempering.

JP 2004-332020 A proposes SUS-type, precipitation-hardened, martensitic, stainless steel having a composition comprising by mass 0.005-0.030% of C, 0.1-0.5% of Si, 0.1-0.7% of Mn, 5-6% of Ni, 15-17% of Cr, 0.5-1.5% of Mo, 2-5% of Cu, 0.10-0.40% of Nb, and 0.005-0.030% of N, the rest being Fe and inevitable impurities, which is subjected to (1) quenching at a relatively low temperature to have a low-strain martensitic structure in which small amounts of C and N are dissolved, (2) a first aging treatment comprising keeping the cast stainless steel at a high temperature of 700-800° C. for 15 minutes to 20 hours, and then cooling it to room temperature, thereby making Cu, a precipitation-hardening element, coarser to lose hardenability, and then (3) a second aging treatment comprising keeping the cast stainless steel at a temperature of 600-680° C., at which the maximum amount of reverse-transformed austenite is formed from a martensite phase, for 15 minutes to 20 hours, and then cooling it to room temperature, thereby precipitating 30% or more by volume of low-hardness, reverse-transformed austenite for its interconnection to improve machinability after tempering. This precipitation-hardened, martensitic, stainless steel is provided with reduced hardness after a solution treatment with the amounts of C and N reduced, and has excellent machinability by the structure control steps (1)-(3).

However, this precipitation-hardened, martensitic, stainless steel has poor castability, because the C content is 0.03% or less by mass to reduce hardness. Also, because as much reverse-transformed austenite as 30% or more by volume is precipitated to improve machinability, the machinability is extremely deteriorated by deformation-induced, martensitic transformation, when used for cutting. In addition, because the first and second aging treatments (corresponding to tempering treatment) are conducted at higher temperatures than usual after a solution treatment (corresponding to quenching treatment), it needs a larger number of heat treatments with larger energy consumption, so that the steel is likely to have heat treatment strain that cannot be removed easily, resulting in a higher production cost.

There are thus various proposals to improve workability in a quenched state in the SUS-type, precipitation-hardened, martensitic, stainless steel, and a proposal to improve machinability in a tempered state (JP 2004-332020 A). However, with respect to the SCS-type, precipitation-hardened, martensitic, cast stainless steel, there is no proposal to improve machinability in a tempered state.

OBJECT OF THE INVENTION

Accordingly, an object of the present invention is to provide precipitation-hardened, martensitic, cast stainless steel having good castability and high strength as well as excellent machinability in a tempered state, and its production method.

DISCLOSURE OF THE INVENTION

As a result of intensive research in view of the above object, the inventors have found that by optimizing a composition range, and controlling a tempering temperature to provide a structure in which Cu precipitates are dispersed in a tempered-martensite-based matrix, it is possible to produce precipitation-hardened, martensitic, cast stainless steel having good castability and high strength as well as drastically improved machinability in a tempered state. The present invention has been completed based on such finding.

Thus, the precipitation-hardened, martensitic, cast stainless steel of the present invention having excellent machinability has a composition comprising, by mass, 0.08-0.18% of C, 1.5% or less of Si, 2.0% or less of Mn, 0.005-0.4% of S, 13.5-16.5% of Cr, 3.0-5.5% of Ni, 0.5-2.8% of Cu, 1.0-2.0% of Nb, and 0.12% or less of N, the amounts of C, N and Nb meeting the condition of $-0.2 \leq 9$ (C %+0.86N %)−Nb %≤1.0, the rest being Fe and inevitable impurities, the structure of the cast stainless steel having Cu precipitates having an average particle size of 0.1-0.4 μm dispersed in a tempered-martensite-based matrix.

An area ratio of residual austenite in said structure is preferably 10% or less.

The precipitation-hardened, martensitic, cast stainless steel of the present invention may further contain 1.0% or less by mass of Mo and/or 1.0% or less by mass of W.

The precipitation-hardened, martensitic, cast stainless steel of the present invention preferably has 0.2-% yield strength of 880 MPa or more at room temperature in a tempered state.

The precipitation-hardened, martensitic, cast stainless steel of the present invention can be obtained by a tempering treatment at a temperature of 550° C. to T° C., wherein T=710−27Ni %, after quenching.

The method of the present invention for producing precipitation-hardened, martensitic, cast stainless steel having excellent machinability comprises the steps of producing cast stainless steel having a composition comprising, by mass, 0.08-0.18% of C, 1.5% or less of Si, 2.0% or less of Mn, 0.005-0.4% of S, 13.5-16.5% of Cr, 3.0-5.5% of Ni, 0.5-2.8% of Cu, 1.0-2.0% of Nb, and 0.12% or less of N, the amounts of C, N and Nb meeting the condition of $-0.2 \leq 9$ (C %+0.86N %)−Nb %≤1.0, the rest being Fe and inevitable impurities; quenching it; and then tempering it at a temperature of 550° C. to T° C., wherein T=710−27Ni %.

BRIEF DESCRIPTION OF THE DRAWINGS

FIG. 3(*b*) is a cross-sectional view taken along the line A-A in FIG. 3(*a*).

DESCRIPTION OF THE PREFERRED EMBODIMENTS

The precipitation-hardened, martensitic, cast stainless steel of the present invention comprises 13.5-16.5% by mass of Cr and 3.0-5.5% by mass of Ni, the amounts of C, N and Nb meeting the condition of $-0.2 \leq 9$ (C %+0.86N %)−Nb %≤1.0. Accordingly, both of its martensitic transformation-starting temperature (Ms point) and martensitic transformation-finishing temperature (Mf point) in the course of temperature decrease are equal to or higher than room temperature, resulting in an as-cast structure having eutectic carbonitride Nb(CN), sulfide, Cr carbide, etc., in a matrix comprising quenched martensite (transformed from austenite) as a main phase and a small amount of a δ ferrite phase and a residual austenite phase. Because the as-cast steel has coarse Cr carbide precipitated in crystal grain boundaries, it is so brittle because of poor toughness that its machining such as cutting is difficult.

To improve toughness, a quenching treatment comprising heating to 900-1050° C. and then quenching with water, oil, air, etc. is conducted after casting. The quenching treatment transforms austenite to a quenched martensite matrix, which is made homogeneous by dissolving Cr carbide. As a result, the cast steel is provided with toughness improved to permit rough machining. However, the cast steel still has insufficient toughness with low tensile strength and 0.2-% yield strength. In addition, thermal strain due to a quenching treatment at a relatively high temperature, and deformation due to rough machining remain in the stainless steel. Because the cast steel in this state cannot be used for machine parts and structure parts needing high toughness and strength, a tempering treatment is conducted to impart further toughness and to remove strain.

Figure 1:
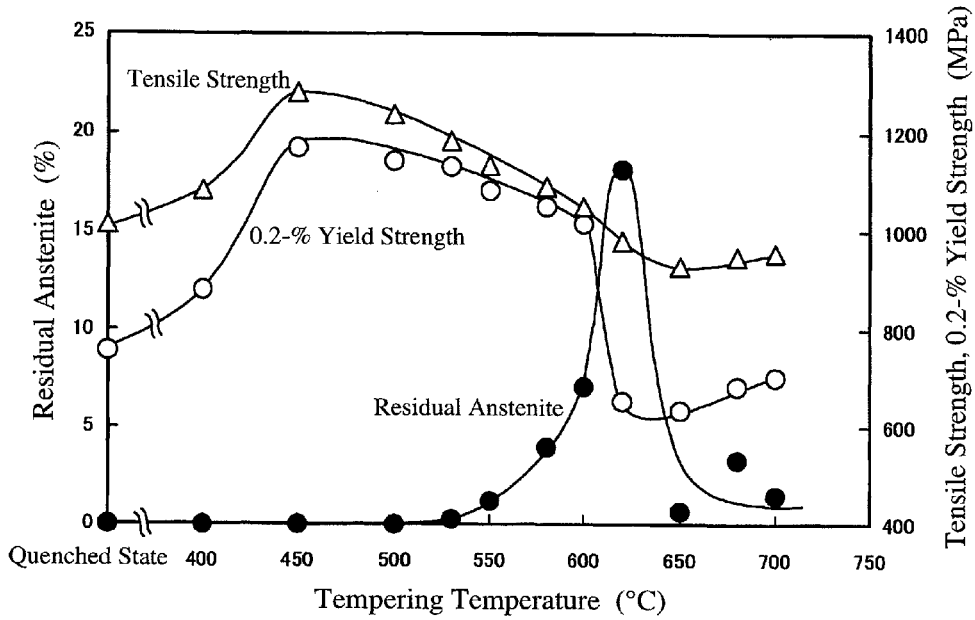
FIG. 1 is a graph showing the relation between a tempering temperature and 0.2-% yield strength, tensile strength and an area ratio of residual austenite in the cast steel F of the present invention.

FIG. 1 shows the relation between a tempering temperature and 0.2-% yield strength at room temperature, tensile strength and an area ratio of residual austenite in the cast steel F in Example 1. The strength and the area ratio of residual austenite largely change depending on the tempering temperature; the maximum strength at a tempering temperature of about 450° C., and the maximum area ratio of residual austenite at a tempering temperature of about 620° C. are obtained.

When the cast steel of the present invention is tempered at a temperature of 400° C. or higher, dislocation annihilates in the martensite, so that the quenched martensite is transformed to tempered martensite, and that fine Cu precipitates called "Cu-rich phase" are formed in the matrix, thereby providing the cast steel with improved hardness and strength. Unless particularly restricted, the as-cast martensite and the quenched martensite are called "quenched martensite," and the martensite in a tempered state is called "tempered martensite." As the tempering temperature is elevated, precipitation hardening with Cu is accelerated, resulting in the maximum hardness and strength at about 450° C. At temperatures higher than 450° C., Cu precipitates become coarser, rather decreasing hardness and strength. The temperature at which the maximum hardness and strength are obtained is called "peak tempering temperature."

When the tempering temperature is about 550° C. or higher, reverse-transformed austenite is formed from the tempered martensite. The reverse-transformed austenite is transformed to quenched martensite during cooling. Having components-segregated portions having a low Ms point, the reverse-transformed austenite remains even when cooled to room temperature. The reverse-transformed austenite is soft, lowering the hardness and strength of the cast steel. Unless otherwise mentioned herein, austenite remaining in the as-cast structure and the quenched structure, and the reverse-transformed austenite remaining even when cooled to room temperature after tempering are called "residual austenite" as a whole.

In the cast steel shown in FIG. 1, residual austenite drastically increases from a tempering temperature of about 600° C., with large decrease in 0.2-% yield strength and slight decrease in tensile strength. This appears to be due to the fact that increase in the residual austenite leads to extreme decrease in 0.2-% yield strength, while tensile strength slightly increases by the deformation-induced, martensitic transformation of residual austenite in a tensile test at room temperature. Thus, the reduction of yield strength is caused not only by growing to coarser Cu precipitates, but also by increase in residual austenite.

Further elevation of a tempering temperature to about 620° C. maximizes the percentage of residual austenite. It is thus considered that the cast steel F has an austenitic-transformation-starting temperature (As point) of about 620° C. Most Cu precipitates are dissolved in the matrix at temperatures equal to or higher than the As point, resulting in a homogeneous structure. Accordingly, most reverse-transformed austenite is transformed to quenched martensite in the course of cooling, resulting in a structure having quenched martensite as a main phase. The tempering treatment at a temperature equal to or higher than the As point turns the structure to as-cast or quenched one despite reduced residual austenite at room temperature, so that tempering effects disappear.

The precipitation hardening of fine Cu precipitates at a peak tempering temperature provides the cast steel with maximum hardness and strength, despite extremely lower machinability than in a quenched state. It may be considered to conduct the tempering treatment at a temperature lower or higher than the peak tempering temperature to improve the machinability. However, when the tempering temperature is lower than the peak temperature, inherent tempering effects (increase in strength and toughness and the removal of strain and deformation by precipitation hardening) cannot be achieved. At too higher a temperature than the peak tempering temperature, the re-solution of Cu precipitates and the formation of large amounts of quenched martensite and residual austenite occur, failing to obtain the tempering effects. The machinability of the cast steel is reduced, because the deformation-induced, martensitic transformation occurs by a large amount of residual austenite.

Investigation on the relation between a tempering temperature and strength and a structure has revealed that with the optimum composition range, a tempering treatment at a proper temperature high than the peak tempering temperature can optimally control a cast steel structure to drastically improve machinability while keeping good castability and high strength. The optimum cast steel structure is that Cu precipitates having appropriate sizes are dispersed in a soft, tempered-martensite-based matrix changed from quenched martensite by the annihilation of dislocation in the martensite. Investigation on the optimum size of Cu precipitates has revealed that Cu precipitates having an average particle size of 0.1-0.4 μm provide drastically improved machinability. To obtain excellent machinability, the area ratio of residual austenite in the cast steel structure is preferably 10% or less.

To obtain the above cast steel structure, it is necessary that (a) the lower limit of the tempering temperature is 550° C., high than the peak tempering temperature, and that (b) the upper limit T of the tempering temperature is lower than the As point. However, because the As point largely depends on the Ni content in the cast steel of the present invention, the upper limit T should be determined based on the Ni content. Intensive research has revealed that to suppress the formation of residual austenite as much as possible while maintaining a tempered-martensite-based matrix with the re-generation of quenched martensite suppressed, and to prevent the re-dissolving of Cu precipitates, the upper limit T of the tempering temperature should be a temperature determined by (710–27Ni %). The tempering treatment in this temperature range can provide precipitation-hardened, martensitic, cast stainless steel with drastically improved machinability, in which Cu precipitates having an average particle size of 0.1-0.4 μm are dispersed in a tempered-martensite-based matrix. After tempering, finish-working is conducted utilizing excellent machinability, to remove scale and strain, thereby obtaining the desired surface roughness and dimensional accuracy.

[1] Composition

In the precipitation-hardened, martensitic, cast stainless steel of the present invention, slight variation of component elements changes the amounts of martensite, δ ferrite, residual austenite, eutectic carbonitride Nb(CN), etc., thereby affecting its structure, mechanical properties and machinability. When a large amount of δ ferrite is crystallized, the cast stainless steel is provided with reduced strength and toughness, and lowered corrosion resistance because of predominant corrosion of δ ferrite. The residual austenite reduces the machinability in a tempered state as described above. The eutectic carbonitride Nb(CN) crystallized in an excess amount reduces the ductility and machinability of the cast stainless steel, though its crystallization in a proper amount improves castability, strength and toughness. To obtain the tempered-martensite-based structure, it is necessary to optimize not only the tempering temperature but also the composition range.

(1) 0.08-0.18% By Mass of C

C is combined with Nb together with N to crystallize eutectic carbonitride Nb(CN), thereby providing the cast steel with improved strength and toughness, a lowered solidification temperature, and improved castability (flowability of molten metal). Good castability makes it possible to produce castings with complicated and/or thin shapes at high yields while suppressing casting defects. Good castability is achieved by increasing C in the present invention. This is based on an opposite idea to the conventional C-reducing method adopted to improve the machinability of this type of cast steel. At least 0.08% by mass of C is needed for good castability, but when C exceeds 0.18% by mass, the amounts of carbides of Cr, etc. and eutectic carbonitride Nb(CN) increase, and a large amount of C is dissolved in the martensite matrix, hardening the matrix and increasing cutting resistance (lowering machinability). Accordingly, the C content is 0.08-0.18% by mass, preferably 0.10-0.15% by mass.

(2) 1.5% or Less by Mass of Si

Si has a deoxidizing function, preventing gas defects due to a CO gas, etc., thereby securing castability. However, Si exceeding 1.5% by mass reduces the machinability. Accordingly, Si is 1.5% or less by mass.

(3) 2.0% or Less by Mass of Mn

Mn has a deoxidizing function, and forms non-metallic inclusions to improve the machinability. However, Mn exceeding 2.0% by mass reduces the toughness, and accelerates the erosion of refractory materials of melting furnaces, thereby lowering productivity and increasing a production cost. Accordingly, Mn is 2.0% or less by mass.

(4) 0.005-0.4% by Mass of S

A trace amount of S forms Mn sulfide and Cr sulfide [MnS or (Mn/Cr)S], improving the machinability and the melt flowability. To obtain such effects, S should be 0.005% or more by mass, but S exceeding 0.4% by mass reduces the toughness. Accordingly, S is 0.005-0.4% by mass.

(5) 13.5-16.5% by Mass of Cr

Cr is an indispensable element for corrosion resistance, and the coexistence of Cr and Ni turns the matrix to martensite, thereby increasing the strength. To obtain such effects, Cr should be 13.5% or more by mass. However, Cr exceeding 16.5% by mass increases Cr carbides thereby reducing ductility and machinability, increases 6 ferrite thereby reducing strength and toughness, and increases residual austenite in quenching thereby lowering machinability. Accordingly, Cr is 13.5-16.5% by mass.

(6) 3.0-5.5% by Mass of Ni

Coexisting with Cr, Ni improves the strength, toughness and corrosion resistance of the cast steel. Ni is a particularly important element, whose content largely affects the structure and properties of the cast steel of the present invention. Ni turns the matrix to martensite, thereby improving strength, toughness and corrosion resistance. To obtain such effects, Ni should be 3.0% or more by mass. However, when a large amount of Ni reducing an Ms point is contained, the martensitic transformation does not easily occur, so that residual austenite increases not only in an as-cast state and a quenched state, but also in a tempered state, reducing the machinability, and lowering the precipitation hardenability, making it difficult to obtain sufficient strength and toughness. Particularly, the tempering treatment increases reverse-transformed austenite, so that more reverse-transformed austenite is transformed to quenched martensite during cooling in the tempering treatment, resulting in extremely reduced machinability. Because this problem is remarkable when Ni exceeds 5.5% by mass, the upper limit of Ni is 5.5% by mass. Accordingly, Ni is 3.0-5.5% by mass, preferably 3.3-5.0% by mass.

(7) 0.5-2.8% by Mass of Cu

The tempering treatment forms Cu precipitates (Cu-rich phase) in the martensite matrix by to increase hardness and strength, and relatively large Cu precipitates improve the machinability. Cu further improves the corrosion resistance of the cast stainless steel. To obtain such effects, Cu should be 0.5% or more by mass. However, too much Cu provides excess precipitation hardening and remarkable embrittlement due to the segregation of Cu in grain boundaries during quenching, and lowers a temperature of starting the segregation of Cu in grain boundaries. Only a quenching treatment (solution treatment) can eliminate micro-segregation in the cast steel, and the quenching temperature is preferably as high as possible for thick castings in which micro-segregation occurs easily. There are thus contradictory requirements that the quenching temperature should be low to suppress the segregation of Cu in grain boundaries, while it should be high to eliminate the micro-segregation. To suppress excess precipitation hardening, segregation in grain boundaries and micro-segregation, the upper limit of the Cu content is 2.8% by mass. When Cu exceeds 2.8% by mass, there is remarkable decrease in machinability and ductility for the above-described reasons. Accordingly, Cu is 0.5-2.8% by mass, preferably 0.8-2.5% by mass.

(8) 1.0-2.0% by Mass of Nb

Nb is combined with C and N to crystallize eutectic carbonitride Nb(CN), thereby increasing the strength of the cast steel. Nb also improves the melt fluidity, and prevents casting defects such as shrinkage cavities, hot tears, etc. Nb further suppresses the precipitation of coarse carbides such as Cr carbides, etc., thereby avoiding decrease in ductility and securing machinability. To obtain such effects, Nb should be 1.0% or more by mass. On the other hand, Nb exceeding 2.0% by mass provides excess eutectic carbonitride, rather decreasing the machinability, and the segregation of excess Nb makes the cast steel brittle. Accordingly, Nb is 1.0-2.0% by mass.

(9) 0.12% or Less by Mass of N

N is combined with Nb together with C to crystallize Nb(CN) eutectic carbonitride, improving the strength, corrosion resistance and castability of the cast steel. N also suppresses the formation of δ ferrite, which lowers the strength and toughness. To obtain the above effect, N is 0.12% or less by mass. When N exceeds 0.12% by mass, the toughness is reduced by excess crystallization of eutectic carbonitride Nb(CN). Though not restrictive, the lower limit of the N content may be 0.005% by mass to have the above effect remarkably.

(10) $-0.2 \leq 9\,(C\,\% + 0.86N\,\%) - Nb\,\% \leq 1.0$

Because eutectic carbonitride Nb(CN) crystallized in grain boundaries during casting the steel of the present invention does not disappear by quenching and tempering, tempering at high temperatures than the peak tempering temperature would not drastically reduce the strength. The fixing of C and N by Nb to form eutectic carbonitride prevents the dissolving of C and N in the martensite matrix, which lowers an Ms point, thereby suppressing residual austenite from increasing. To control the formation of eutectic carbonitride Nb(CN) properly, it is important that the amounts of C, N and Nb are well balanced. This balance can be expressed by [9 (C %+0.86N %)−Nb %] (CNNb value). With the CNNb value controlled in a range of −0.2 to 1.0, a proper amount of eutectic carbonitride Nb(CN) is formed to provide good castability, strength and machinability. When the CNNb value exceeds 1.0, Nb is insufficient relative to C and N, resulting in increased residual austenite and reduced machinability and strength. When the CNNb value is less than −0.2, Nb is excessive relative to C and N, so that the cast steel is brittle because of the segregation of Nb. Accordingly, the amounts of C, N and Nb should meet the condition of $-0.2 \leq 9\,(C\,\% + 0.86N\,\%) - Nb\,\% \leq 1.0$.

(11) 1.0% or Less by Mass of Mo and/or 1.0% or Less by Mass of W

The cast steel of the present invention may further contain 1.0% or less by mass of Mo and/or 1.0% or less by mass of W. Both Mo and W improve the strength of the cast steel, and Mo increases a corrosion-resistance-increasing effect. If too much, however, any of them would lower the ductility.

(12) Inevitable Impurities

Any of inevitable impurities such as P, O, etc. intruding with starting materials and in a melting step would not extremely deteriorate the machinability, strength and toughness if it were 0.05% or less by mass.

[2] Structure (1) Tempered-Martensite-Based Matrix

The cast steel of the present invention having a tempered-martensite-based matrix as a main phase after quenching and tempering can be provided with improved machinability while maintaining high strength. The term "tempered-martensite-based" means that the area ratio of tempered martensite is about 70% or more in the matrix. In addition to the tempered martensite, the matrix may contain eutectic carbonitride Nb(CN), a small amount of δ ferrite, residual austenite, and sulfides.

(2) Cu Precipitates Having Average Particle Size of 0.1-0.4 μm

Because the cast steel of the present invention has a structure, in which Cu precipitates having an average particle size of 0.1-0.4 μm are dispersed in the tempered-martensite-based matrix, it has high strength due to precipitation hardening, and drastically improved machinability. Why the size of Cu precipitates affects the strength is not necessarily clear, but it is presumed that (a) when a large number of relatively small Cu precipitates are precipitated, strain occurs in the structure to constrain dislocation, thereby increasing hardness and strength, and that (b) when a small number of coarse Cu precipitates are precipitated, less constraint of dislocation and the growth of soft Cu improve machinability. The "average particle size" is obtained by selecting the largest five Cu precipitates in regions each 10 μm×10 μm in 3 arbitrary fields in an electron photomicrograph, calculating the value of (Ds+Dl)/2 from a short diameter Ds and a long diameter Dl of each Cu precipitate particle, and averaging the above values of all 15 Cu precipitate particles. Why the largest five Cu precipitates are selected is that fine Cu precipitates have substantially no influence on the improvement of machinability. Accordingly, even if fine Cu precipitates having an average particle size of less than 0.1 μm are dispersed in the matrix, the requirement that "Cu precipitates having an average particle size of 0.1-0.4 μm are dispersed" is met.

If the average particle size of Cu precipitates were less than 0.1 μm after the tempering treatment, the cast stainless steel would have poor machinability. On the other hand, when the average particle size of Cu precipitates exceeds 0.4 μm, Cu precipitates start to be dissolved in the matrix, resulting in decreased strength. Accordingly, the cast steel of the present invention should have a structure in which Cu precipitates having an average particle size of 0.1-0.4 μm are dispersed in the tempered-martensite-based matrix. The average particle size of Cu precipitates is controlled by the tempering temperature. When the average particle size of Cu precipitates is 0.15-0.3 μm, the machinability is further improved. Though not restrictive, the number of Cu precipitates having an average particle size of 0.1-0.4 μm is preferably 5 or more, more preferably 10 or more, per 100 $\mu m^2$ of the matrix, from the aspect of machinability.

(3) Residual Austenite Having Area Ratio of 10% or Less

The residual austenite is subjected to deformation-induced, martensitic transformation during machining, thereby reducing the machinability of the cast steel. Accordingly, the amount of residual austenite is preferably as small as possible, specifically its area ratio is preferably 10% or less, more preferably 5% or less.

[3] Properties

The precipitation-hardened, martensitic, cast stainless steel meeting the requirement of the composition and structure of the present invention has 0.2-% yield strength (room temperature) of 880 MPa or more in a tempered state. Because the composition range and tempering temperature are optimized for excellent machinability and high strength, even tempering at higher temperatures than the peak tempering temperature can provide the precipitation-hardened, martensitic, cast stainless steel with strength comparable to those of SCS24, etc.

Tensile strength and 0.2-% yield strength are important properties for cast parts. As shown in FIG. 1, however, the tempering temperature of 600° C. or higher lowers the tensile strength only slightly, but the 0.2-% yield strength is lowered extremely. Thus, the influence of the tempering temperature can be confirmed more clearly from the 0.2-% yield strength than from the tensile strength. The 0.2-% yield strength (room temperature) of 880 MPa or more in a tempered state is suitable for machine parts and structure parts. The 0.2-% yield strength (room temperature) in a tempered state is more preferably 900 MPa or more, most preferably 980 MPa or more.

Machine parts and structure parts are required to have not only strength but also ductility for preventing cracking and breakage. Although the level of ductility required may differ depending on applications, the precipitation-hardened, martensitic, cast stainless steel of the present invention has room-temperature elongation of preferably 1.0% or more, more preferably 3.0% or more, for practical applications.

[4] Production Method

To obtain a structure in which Cu precipitates having an average particle size of 0.1-0.4 μm are dispersed in the tempered-martensite-based matrix, the tempering temperature should be 550° C. to T° C., wherein T=710−27Ni %. Using a tempering temperature of 550° C. to T° C. with the composition adjusted to the above range, the precipitation-hardened, martensitic, cast stainless steel with high strength and excellent machinability can be obtained.

The lower limit of the tempering temperature is 550° C. By tempering at a temperature about 100° C. or more higher than about 450° C., the peak tempering temperature of the cast steel of the present invention, the annihilation of dislocation in martensite is accelerated, turning the quenched martensite to soft tempered martensite, and making Cu precipitates coarser, thereby reducing the hardenability. Thus, the machinability can be drastically improved while maintaining high strength. When the lower limit of the tempering temperature is lower than 550° C., the softening of martensite and decrease in hardenability by Cu precipitates are insufficient, failing to expect the improvement of machinability.

To make the tempering temperature lower than the As point, the upper limit of the tempering temperature is T° C. (T=710−27Ni %). When the tempering temperature exceeds the As point, most Cu precipitates are re-dissolved, and a large amount of reverse-transformed austenite is formed from the tempered martensite. The reverse-transformed austenite is transformed to quenched martensite in the course of cooling, with part of it remaining as residual austenite, resulting in extremely reduced strength and machinability.

Figure 2:
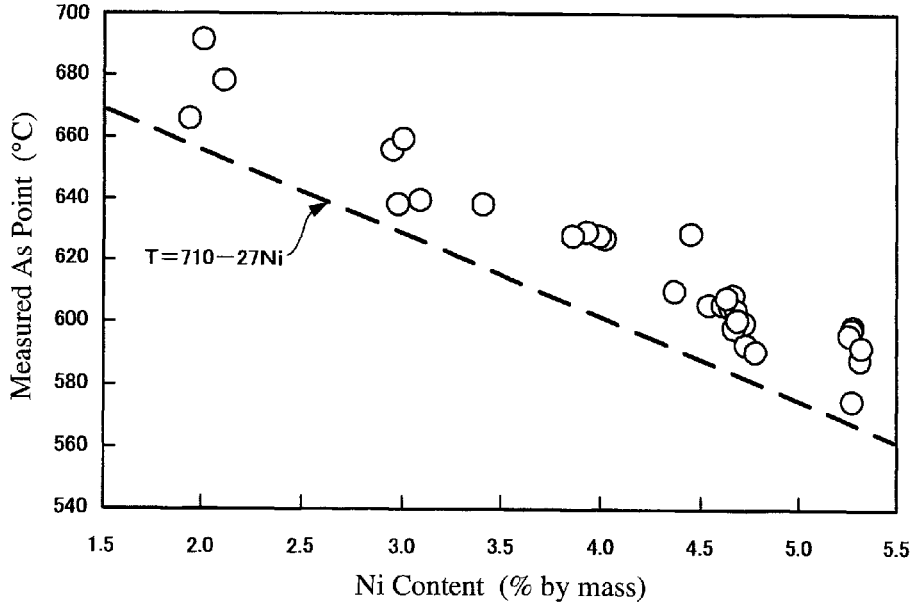
FIG. 2 is a graph showing the relation between a Ni content and the measured As point.

FIG. 2 shows the relation between the Ni content and the measured As point in the precipitation-hardened, martensitic, cast stainless steel, which meets the composition requirement of the present invention except for Ni. The As point is determined from a temperature-displacement curve measured from room temperature to heating temperatures using a thermomechanical analyzer (TMA). As is clear from FIG. 2, the As point of the precipitation-hardened, martensitic, cast stainless steel of the present invention decreases as Ni increases. To prevent the formation of the reverse-transformed austenite with no Cu precipitates re-dissolved, the tempering treatment should be conducted at a temperature variable depending on the Ni content and not exceeding the As point. Why there is unevenness in an As point at the same Ni content appears to be due to the fact that other factors than the Ni content affect the As point if slightly. Taking the unevenness of an As point into consideration, the upper limit T of the tempering temperature is set lower than the lower limit of the measured unevenness range of an As point. Specifically, using a temperature T° C. expressed by a broken line (T=710−27Ni %) in FIG. 2 as the upper limit of the tempering temperature, it is possible to prevent decrease in strength due to the re-dissolving of Cu precipitates, and decrease in machinability due to the formation of reverse-transformed austenite. Accordingly, the upper limit T of the tempering temperature (° C.) is a temperature lower than the As point and expressed by T=710−27Ni %.

After quenching the cast steel having the above composition range, tempering is conducted at a temperature meeting the above requirement to obtain precipitation-hardened, martensitic, cast stainless steel in which Cu precipitates having an average particle size of 0.1-0.4 μm are dispersed in a tempered-martensite-based matrix. This precipitation-hardened, martensitic, cast stainless steel has good castability and high strength, as well as drastically improved machinability in a tempered state. The method of the present invention enjoys a high casting yield, less energy consumption in a heat treatment, and the suppression of strain in the heat treatment, providing drastically improved working efficiency and tool life.

The tempering time, which may be determined by the sizes, shapes, etc. of castings, is preferably about 2-6 hours in industrial applications. Cooling is conducted preferably in a furnace or in the air.

It should be noted that the quenching treatment is not restrictive, but may be conducted under the same conditions as conventional ones for this type of cast steel. For instance, quenching may comprise keeping the cast steel at 900-1050° C., and quenching it with water, oil or wind. With this treatment, a main phase in the matrix becomes quenched martensite, resulting in a homogenous structure. The temperature-keeping time, which may be determined by the size, shape, etc. of castings, is preferably about 0.5-3 hours from the industrial aspect.

The present invention will be explained in further detail by Examples below without intention of restricting the present invention thereto.

Example 1

Figure 3A:
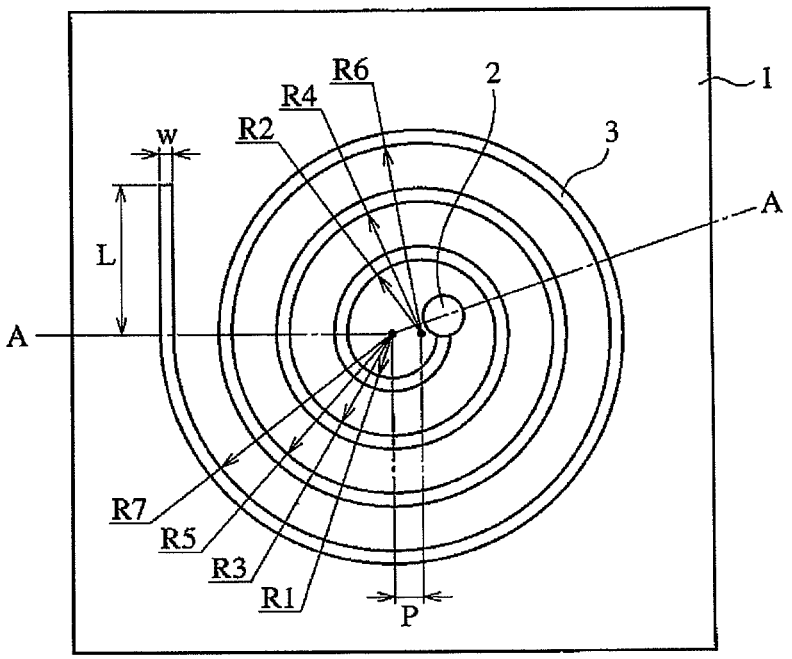
FIG. 3(*a*) is a schematic plan view showing the shapes of a runner and a gate in a melt fluidity test mold.
Figure 3B:
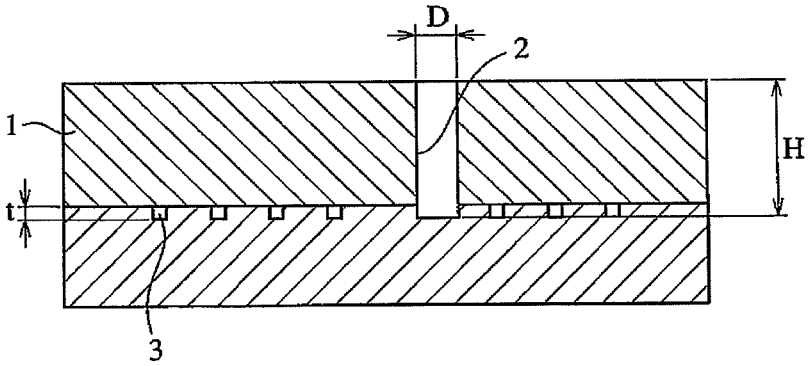

Each cast steel having the composition shown in Table 1 was melted in a high-frequency furnace with 100-kg volume, poured into a ladle at about 1650° C., and cast to a one-inch Y-block and a cylindrical block having a diameter of 120 mm and a height of 150 mm at about 1600° C., and to a melt fluidity test piece having a spiral shape shown in FIG. 3. Cast steels A-L are within the present invention, and cast steels M-U are outside the present invention in any of compositions and the CNNb value [$-0.2 \leq 9$ (C %+0.86N %)−Nb %≤1.0]. Cast steel U corresponds to conventional, precipitation-hardened, martensitic, cast stainless steel SCS24.

TABLE 1

| Type of Steel | Components other than Fe: Composition (% by mass) C | Si | Mn | S | Ni | Cr | Cu | Nb | N | Others | CNNb |
|---|---|---|---|---|---|---|---|---|---|---|---|
| A | 0.12 | 0.54 | 0.69 | 0.10 | 4.1 | 14.5 | 0.5 | 1.30 | 0.080 | — | 0.40 |
| B | 0.12 | 0.53 | 0.67 | 0.11 | 4.0 | 14.4 | 0.8 | 1.35 | 0.095 | — | 0.47 |
| C | 0.08 | 0.50 | 0.66 | 0.09 | 3.0 | 14.9 | 1.2 | 1.00 | 0.020 | — | −0.13 |
| D | 0.10 | 0.55 | 0.60 | 0.08 | 3.3 | 14.3 | 1.8 | 1.35 | 0.035 | — | −0.18 |
| E | 0.12 | 0.56 | 0.65 | 0.05 | 5.0 | 13.9 | 2.3 | 1.40 | 0.065 | — | 0.18 |
| F | 0.12 | 0.48 | 0.64 | 0.09 | 4.0 | 14.6 | 1.9 | 1.31 | 0.066 | — | 0.28 |
| G | 0.14 | 0.50 | 1.25 | 0.28 | 4.2 | 14.8 | 1.8 | 1.33 | 0.067 | — | 0.45 |
| H | 0.12 | 0.54 | 0.66 | 0.09 | 4.0 | 14.1 | 1.8 | 1.49 | 0.086 | Mo: 0.7 | 0.26 |
| I | 0.12 | 0.47 | 0.61 | 0.09 | 3.9 | 13.9 | 1.9 | 1.38 | 0.071 | W: 0.7 | 0.25 |
| J | 0.15 | 0.48 | 0.65 | 0.10 | 4.4 | 16.0 | 2.5 | 1.33 | 0.068 | — | 0.55 |
| K | 0.17 | 0.47 | 0.64 | 0.09 | 5.5 | 14.6 | 2.8 | 1.80 | 0.065 | — | 0.23 |
| L | 0.17 | 0.52 | 0.65 | 0.10 | 4.1 | 14.5 | 1.8 | 1.47 | 0.115 | — | 0.95 |
| M | 0.12 | 0.48 | 0.64 | 0.08 | 4.1 | 17.5 | 2.4 | 1.46 | 0.066 | — | 0.13 |
| N | 0.20 | 0.54 | 0.64 | 0.06 | 3.8 | 13.9 | 2.3 | 1.50 | 0.060 | — | 0.76 |
| O | 0.12 | 0.51 | 0.69 | 0.09 | 4.0 | 14.6 | 0.3 | 1.33 | 0.075 | — | 0.33 |
| P | 0.12 | 0.50 | 0.60 | 0.08 | 3.7 | 14.3 | 3.2 | 1.32 | 0.077 | — | 0.36 |
| Q | 0.17 | 0.48 | 0.58 | 0.11 | 4.3 | 15.8 | 2.1 | 1.00 | 0.085 | — | 1.19 |
| R | 0.12 | 0.49 | 0.68 | 0.10 | 4.0 | 15.2 | 2.0 | 2.10 | 0.079 | — | −0.41 |
| S | 0.11 | 0.58 | 0.77 | 0.06 | 4.1 | 15.0 | 1.9 | 1.55 | 0.132 | — | 0.46 |
| T | 0.12 | 0.51 | 0.69 | 0.09 | 5.7 | 14.9 | 1.9 | 1.40 | 0.065 | — | 0.18 |
| U | 0.05 | 0.50 | 0.66 | 0.01 | 4.0 | 16.5 | 3.0 | 0.31 | 0.015 | — | 0.26 |

Each one-inch Y-block and each cylindrical block were subjected to a quenching treatment comprising keeping them at 1038° C. for 1 hour and then quenching them to room temperature, and a tempering treatment comprising keeping them at the temperature shown in Table 2 for 4 hours and then air-cooling them to room temperature, thereby producing quenched, tempered samples. The symbols of samples in Tables 1 and 2 correspond to each other. Samples identified with symbols having one-digit suffixes like A1, B1 . . . L1 are within the present invention, and those identified with symbols having two-digit suffixes like C11, C12, D11 . . . T11 are outside the present invention.

Each sample was subjected to the following tests.

(1) Tensile Test

A No. 4 tensile test piece according to JIS Z 2201 was produced from each one-inch Y-block sample, to conduct a tensile test at room temperature using an Amsler tensile tester to measure 0.2-% yield strength, tensile strength and elongation.

(2) Structure

The matrix of each sample was identified by structure observation by a transmission electron microscope, and by X-ray diffraction measurement and dislocation density measurement. The average particle size of Cu precipitates was determined by a scanning electron microscope, and the area ratio of residual austenite was determined by an X-ray diffraction method.

(3) Machinability

A test piece of 95 mm in diameter and 150 mm in height was cut out of each cylindrical block sample, and its outer surface was cut by a lathe under the following conditions, using a tool chip comprising a cemented carbide matrix coated with TiAlN by PVD.

Cutting method: Continuous cutting,

Cutting speed: 140 m/minutes,

Feed: 0.1 mm/rev.,

Cutting depth: 0.2 mm, and

Cutting liquid: Aqueous cutting liquid was continuously supplied.

The machinability of each sample is expressed by tool life [cutting time (minute) until the wear of a chip flank reached 0.25 mm]. With respect to each sample, the matrix, the average particle size of Cu precipitates, the area ratio of residual austenite, the tensile test results at room temperature, and the tool life are shown in Table 2.

TABLE 2

Evaluation of structure, mechanical properties and machinability

| Type of Steel | Sample | Tempering Temp. (° C.) | Main Matrix Structure(1) | Average Particle Size of Cu precipitates (μm) | Residual Austenite (%) |
|---|---|---|---|---|---|
| A | A1 | 580 | Tempered M | 0.10-0.13 | 2.2 |
| B | B1 | 580 | Tempered M | 0.10-0.15 | 2.5 |
| C | C1 | 550 | Tempered M | 0.12-0.15 | 0.8 |
| | C2 | 580 | Tempered M | 0.13-0.17 | 1.1 |
| | C3 | 620 | Tempered M | 0.16-0.18 | 5.2 |
| | C11* | 530 | Tempered M | <0.10 | 0.2 |
| | C12* | 640 | Tempered M | No Precipitation | 15.3 |
| D | D1 | 550 | Tempered M | 0.10-0.15 | 1.0 |
| | D2 | 580 | Tempered M | 0.15-0.20 | 2.1 |
| | D3 | 620 | Tempered M | 0.18-0.22 | 6.9 |
| | D11* | 530 | Tempered M | <0.10 | 0.2 |
| | D12* | 640 | Tempered M | No Precipitation | 17.8 |
| E | E1 | 550 | Tempered M | 0.11-0.19 | 4.9 |
| | E2 | 570 | Tempered M | 0.12-0.20 | 6.4 |
| | E11* | 530 | Tempered M | <0.10 | 0.5 |
| | E12* | 590 | Tempered M | No Precipitation | 15.3 |
| F | F1 | 550 | Tempered M | 0.12-0.21 | 1.2 |
| | F2 | 580 | Tempered M | 0.16-0.23 | 4.0 |
| | F3 | 600 | Tempered M | 0.17-0.25 | 7.1 |
| | F11* | 530 | Tempered M | <0.10 | 0.3 |
| | F12* | 620 | Tempered M | No Precipitation | 18.2 |
| | F13* | 680 | Quenched M | No Precipitation | 3.3 |

| Type of Steel | Sample | Tensile Strength (MPa) | 0.2-% Yield Strength (MPa) | Elongation (%) | Tool Life (minute) |
|---|---|---|---|---|---|
| A | A1 | 1002 | 972 | 7.0 | 65 |
| B | B1 | 1024 | 985 | 7.1 | 58 |
| C | C1 | 1101 | 1051 | 6.9 | 57 |
| | C2 | 1029 | 1003 | 7.9 | 62 |
| | C3 | 998 | 954 | 9.8 | 75 |
| | C11* | 1225 | 1167 | 4.8 | 28 |
| | C12* | 915 | 646 | 13.1 | 30 |
| D | D1 | 1109 | 1051 | 6.1 | 61 |
| | D2 | 1029 | 998 | 7.3 | 70 |
| | D3 | 995 | 969 | 9.9 | 75 |
| | D11* | 1208 | 1159 | 3.0 | 29 |
| | D12* | 924 | 628 | 12.5 | 30 |
| E | E1 | 1163 | 1102 | 5.1 | 57 |
| | E2 | 1081 | 1050 | 6.1 | 62 |
| | E11* | 1222 | 1105 | 5.6 | 25 |
| | E12* | 942 | 650 | 10.9 | 27 |
| F | F1 | 1135 | 1085 | 5.2 | 60 |
| | F2 | 1091 | 1052 | 6.8 | 70 |
| | F3 | 1051 | 1016 | 8.8 | 72 |
| | F11* | 1184 | 1132 | 5.6 | 25 |
| | F12* | 980 | 653 | 8.6 | 21 |
| | F13* | 948 | 683 | 7.4 | 24 |

| Type of Steel | Sample | Tempering Temp. (° C.) | Main Matrix Structure(1) | Average Particle Size of Cu Precipitates (μm) | Residual Austenite (%) |
|---|---|---|---|---|---|
| G | G1 | 580 | Tempered M | 0.14-0.17 | 3.6 |
| H | H1 | 580 | Tempered M | 0.14-0.18 | 3.4 |
| I | I1 | 580 | Tempered M | 0.13-0.18 | 4.1 |
| J | J1 | 550 | Tempered M | 0.12-0.20 | 1.2 |
| | J2 | 590 | Tempered M | 0.13-0.28 | 7.9 |
| K | K1 | 560 | Tempered M | 0.12-0.36 | 6.3 |
| | K11* | 530 | Tempered M | <0.10 | 0.6 |
| | K12* | 570 | Tempered M | No Precipitation | 13.2 |
| L | L1 | 580 | Tempered M | 0.14-0.18 | 4.2 |
| | L11* | 530 | Tempered M | <0.10 | 0.9 |
| | L12* | 620 | Tempered M | No Precipitation | 16.4 |
| M | M11* | 580 | Tempered M | 0.13-0.21 | 15.2 |
| N | N11* | 580 | Tempered M | 0.12-0.19 | 3.1 |
| O | O11* | 580 | Tempered M | <0.10 | 4.9 |
| P | P11* | 580 | Tempered M | 0.18-0.42 | 3.5 |
| Q | Q11* | 580 | Tempered M | 0.14-0.17 | 12.7 |
| R | R11* | 580 | Tempered M | 0.13-0.16 | 5.4 |
| S | S11* | 580 | Tempered M | 0.13-0.20 | 5.1 |
| T | T11* | 580 | Tempered M | No Precipitation | 15.5 |
| U | U11** | 580 | Tempered M | 0.16-0.34 | 5.2 |

TABLE 2-continued

| Evaluation of structure, mechanical properties and machinability | | | | | |
|---|---|---|---|---|---|
| Type of Steel | Sample | Tensile Strength (MPa) | 0.2-% Yield Strength (MPa) | Elongation (%) | Tool Life (minute) |
| G | G1 | 1075 | 1039 | 5.0 | 82 |
| H | H1 | 1106 | 1074 | 7.1 | 65 |
| I | I1 | 1102 | 1069 | 6.7 | 62 |
| J | J1 | 1105 | 1055 | 5.6 | 58 |
| | J2 | 1075 | 1047 | 6.8 | 69 |
| K | K1 | 1139 | 1076 | 6.1 | 59 |
| | K11* | 1351 | 1304 | 2.6 | 27 |
| | K12* | 922 | 631 | 12.3 | 23 |
| L | L1 | 1113 | 1068 | 5.8 | 59 |
| | L11* | 1312 | 1261 | 2.9 | 30 |
| | L12* | 898 | 607 | 9.8 | 21 |
| M | M11* | 959 | 850 | 10.9 | 27 |
| N | N11* | 1185 | 1109 | 3.8 | 25 |
| O | O11* | 926 | 848 | 5.9 | 67 |
| P | P11* | 1063 | 1038 | 0.3 | 66 |
| Q | Q11* | 950 | 841 | 10.0 | 22 |
| R | R11* | 899 | Immeasurable | 0.1 | 60 |
| S | S11* | 1102 | 1085 | 0.4 | 62 |
| T | T11* | 909 | 627 | 10.8 | 22 |
| U | U11** | 1004 | 951 | 15.0 | 65 |

Note:
(1)Quenched M: Quenched martensite.
Tempered M: Tempered martensite.

Among cast steels A-L within the composition range of the present invention, any of Samples A1-L1 within the present invention subjected to tempering at a temperature meeting the requirement of 550° C. to T° C., wherein T=710−27Ni %, had a tempered-martensite-based matrix, in which about 5-100 relatively large Cu precipitates having an average particle size of 0.1 μm or more were dispersed per 100 $\mu m^2$ of the matrix. As shown in Table 2, any of Samples A1-L1 had an average particle size of Cu precipitates in a range of 0.1-0.4 μm, a residual austenite area ratio of 10% or less, tool life of 50 minutes or more as an index of machinability, 0.2-% yield strength of 880 MPa or more, and tensile strength of 950 MPa or more. These data indicate that Samples A1-L1 within the present invention had excellent machinability and high strength. Particularly, Samples C3, D2, D3, F2 and F3 in which the average particle size of Cu precipitates was in a preferred range of 0.15-0.3 μm, and Sample G1 containing large amounts of Mn and S had tool life of 70 minutes or more, excellent machinability. Samples H1 and I1 containing Mo and W had higher 0.2-% yield strength than that of Sample F2 containing other elements than Mo and W to the same level. It is thus clear that the addition of Mo or W improves strength.

Cast steel F containing 4.0% by mass of Ni was quenched under the same conditions as above, subjected to a tempering treatment comprising keeping it at each temperature for 4 hours and air-cooling it to room temperature, and then measured with respect to tensile strength and 0.2-% yield strength at room temperature, and the percentage of residual austenite. The results are shown in FIG. 1. The upper limit T of a tempering temperature suitable for the cast steel F is 710−27×4.0 (Ni %)=602° C. It is clear from FIG. 1 and the comparison of Samples F1-F3 within the present invention with Samples F11-F13 outside the present invention that the cast steel F obtained with a tempering temperature of 550-600° C. had excellent machinability and high strength; an average particle size of Cu precipitates in a range of 0.12-0.25 μm, as low a residual austenite area ratio as 10% or less, as high 0.2-% yield strength as 880 MPa or more, and as long tool life as 60 minutes or more.

On the other hand, in Samples C11, D11, E11, F11, K11 and L11 within the composition range of the present invention but tempered at temperatures lower than the lower limit (550° C.), only fine Cu precipitates having an average particle size of less than 0.10 μm (about several tens of nanometers) were dispersed in the matrix, with the amount of residual austenite as small as 1.0% or less. They had tool life of 30 minutes or less, insufficient machinability, despite high 0.2-% yield strength and tensile strength. This appears to be due to the fact that because of too low tempering temperatures, the softening of martensite and reduced hardening due to coarser Cu precipitates took place insufficiently.

In Samples C12, D12, E12, F12, K12 and L12 within the composition range of the present invention but tempered at temperatures exceeding the upper limit T, Cu precipitates were not observed in the matrix, with poor machinability and strength; the area ratio of residual austenite exceeding 10%, the tool life as short as 30 minutes or less, and the 0.2-% yield strength as low as about 650 MPa or less. This appears to be due to the fact that because of too high tempering temperatures, Cu precipitates were dissolved in the matrix, and large amounts of reverse-transformed austenite and quenched martensite were formed.

Sample F13 tempered at a temperature of 680° C., about 80° C. higher than the upper limit temperature T, had poor machinability and strength; the tool life as short as 24 minutes, the 0.2-% yield strength as low as 683 MPa, despite as low an area ratio of residual austenite as 3.3%. Sample F13 has a quenched-martensite-based matrix containing no Cu precipitates. This appears to be due to the fact that because of extremely too high tempering temperature, Cu precipitates were dissolved in the matrix, and the reverse-transformed austenite was transformed to quenched martensite, so that the matrix was based on quenched martensite despite decrease in residual austenite, thereby erasing a tempering effect.

Samples M11-T11, in which any one of the composition and the CNNb value was outside the present invention, were poor in at least one of machinability, 0.2-% yield strength and elongation. In Samples M11, Q11 and T11, in which the Cr content, the CNNb value and the Ni content exceeded the upper limit of the present invention, had area ratios of residual austenite exceeding 10%, tool life as short as 30 minutes or less, and insufficient 0.2-% yield strength. Sample T11 whose tempering temperature exceeded the upper limit T contained no Cu precipitates.

Sample N11 containing too much C had poor machinability due to excess precipitation of eutectic carbonitride Nb(CN), despite high 0.2-% yield strength. Sample O11 having too small a Cu content had low 0.2-% yield strength despite good machinability. This is presumably because sufficient precipitation hardening did not occur because of insufficient Cu.

Samples P11 containing too much Cu, Sample R11 containing too much Nb and having a CNNb value less than the lower limit of the present invention, and Sample S11 containing too much N had small area ratios of residual austenite and poor ductility, elongation of 1.0% or less at room temperature, despite good machinability. What lowered elongation appears to be structure embrittlement, due to the segregation of Cu in grain boundaries occurring during quenching because of excess Cu in Sample P11, the excess precipitation of eutectic carbonitride Nb(CN) and the segregation of Nb occurring because of excess Nb in Sample R11, and the dissolution of a large amount of N in a martensite matrix in Sample S11. Particularly, Sample R11 had extremely low elongation of 0.1%, unable to measure its 0.2-% yield strength. If precipitation-hardened, martensitic, cast stainless steel had as low elongation as less than 1.0%, it would not be able to be used for machine parts and structure parts because of insufficient ductility, even though it had excellent machinability and high strength. Sample U11 obtained by conducting the tempering treatment of the present invention on the cast steel U corresponding to SCS24 had poor castability because of too small a C content, despite satisfactory area ratio of residual austenite, tool life, and 0.2-% yield strength and elongation.

Example 2

To evaluate the castability of cast steels C, F, J and U having different C contents, a molten metal fluidity test was conducted using a molten metal fluidity test mold 1 (self-hardening sand mold containing an alkaline phenol-ester organic resin) shown in FIGS. 3(*a*) and 3(*b*). This test mold 1 comprises a center gate 2 having a circular cross section, and a rectangular-cross-sectioned, spiral runner 3 of about 3.5 turns connected to the gate 2. A molten metal entering the runner 3 forms a casting having length corresponding to its castability (molten metal fluidity). Accordingly, the fluidity of the molten metal can be elevated by measuring the length (flow length) of a casting formed in the runner 3. In FIG. 3, each part has the following size: R1=32.9 mm, R2=53.4 mm, R3=73.6 mm, R4=93.9 mm, R5=114.3 mm, R6=134.6 mm, R7=155.2 mm, P=20.8 mm, L=108 mm, H=100 mm, D=35 mm, W=10 mm, and t=10 mm.

A molten metal of each cast steel C, F, J and U obtained under the same conditions as in Example 1 was poured at a temperature of 1550° C.±5° C. into the runner 3 through the gate 2. The molten metal flowing through the runner 3 was cooled to solidification. The distance (mm) from the gate 2 in which the molten metal flowed was measured as flow length. Measurement was conducted twice to obtain an average value. The results are shown in Table 3.

TABLE 3

Evaluation of melt fluidity

| Type of Steel | Flow Length (mm) |
|---|---|
| C | 1070 |
| F | 1190 |
| J | 1210 |
| U | 810 |

As shown in Table 3, any of the cast steels C, F and J of the present invention containing 0.08% or more by mass of C had flow length of 1000 mm or more, exhibiting excellent castability. On the other hand, the cast steel U (containing 0.05% by mass of C) corresponding to conventional, precipitation-hardened, martensitic, cast stainless steel SCS24 had flow length of 810 mm, about 80% of those of the cast steels C, F and J, exhibiting poor castability. The comparison of the cast steels C, F and J revealed that as the C content increased, the flow length became longer, improving castability.

Effect of the Invention

Because the precipitation-hardened, martensitic, cast stainless steel of the present invention obtained by the optimized composition range and tempering temperature has a structure in which Cu precipitates with the desired size are dispersed in a tempered-martensite-based matrix, it has high strength as well as excellent machinability in a tempered state. In addition, because it contains 0.08% or more by mass of C, it has such good castability that castings even with complicated and/or thin shapes free from casting defects can be produced with a high yield. The precipitation-hardened, martensitic, cast stainless steel of the present invention having such feature can be produced with suppressed heat treatment strain, with energy saved in a heat treatment step, providing drastically improved working efficiency and long tool life.

The precipitation-hardened, martensitic, cast stainless steel of the present invention is suitable for applications needing good machinability because it is machined after tempering, for instance, machine parts and structure parts such as propellers, shafts, pumps, valves, levers, impellers, liners, casings, jaws, suits, etc., which are used for vessels, construction machines, automobiles, chemical industries, industrial machines, etc. Utilizing excellent castability, it is also suitable for castings with complicated and/or thin shapes.

What is claimed is:

1. A precipitation-hardened, martensitic, cast stainless steel having excellent machinability, which has a composition consisting of, by mass, 0.10-0.18% of C, 1.5% or less of Si, 2.0% or less of Mn, 0.05-0.4% of S, 13.5-16.5% of Cr, 3.0-5.0% of Ni, 0.5-2.8% of Cu, 1.3-2.0% of Nb, and 0.12% or less of N, the amounts of C, N and Nb meeting the condition of $-0.2 \leq 9\,(C\,\% + 0.86N\,\%) - Nb\,\% \leq 1.0$, the rest being Fe and inevitable impurities; the structure of said cast stainless steel having Cu precipitates having an average particle size of 0.1-0.4 μm dispersed in a tempered-martensite-based matrix.

2. The precipitation-hardened, martensitic, cast stainless steel according to claim 1, wherein said structure has an area ratio of residual austenite in a range of 10% or less.

3. The precipitation-hardened, martensitic, cast stainless steel according to claim 1, which has 0.2-% yield strength of 880 MPa or more at room temperature.

4. The precipitation-hardened, martensitic, cast stainless steel according to claim 1, which is obtained by a tempering treatment at a temperature of 550° C. to T° C., wherein T=710−27Ni %, after quenching.

* * * * *